US010221510B2

(12) United States Patent
Lin et al.

(10) Patent No.: US 10,221,510 B2
(45) Date of Patent: Mar. 5, 2019

(54) NON-WOVEN FABRIC AND METHOD AND APPARATUS OF MANUFACTURING THE SAME

(71) Applicants: Victor J Lin, Wasington, NJ (US); Cheng-Kun Chu, New Taipei (TW); Ming-Chih Kuo, New Taipei (TW); Chao-Chun Peng, New Taipei (TW); Chia-Kun Wen, New Taipei (TW)

(72) Inventors: Victor J Lin, Wasington, NJ (US); Cheng-Kun Chu, New Taipei (TW); Ming-Chih Kuo, New Taipei (TW); Chao-Chun Peng, New Taipei (TW); Chia-Kun Wen, New Taipei (TW)

(73) Assignee: Victor J. Lin, Washington, NJ (US)

( * ) Notice: Subject to any disclaimer, the term of this patent is extended or adjusted under 35 U.S.C. 154(b) by 0 days.

(21) Appl. No.: 15/708,138

(22) Filed: Sep. 19, 2017

(65) Prior Publication Data

US 2018/0258565 A1 Sep. 13, 2018

Related U.S. Application Data

(63) Continuation of application No. 13/759,293, filed on Feb. 5, 2013.

(30) Foreign Application Priority Data

May 25, 2012 (TW) ..... 101118712 A

(51) Int. Cl.

| | |
|---|---|
| ***D04H 1/54*** | (2012.01) |
| ***D04H 1/56*** | (2006.01) |
| ***D01G 15/12*** | (2006.01) |

(52) U.S. Cl.

CPC ..... *D04H 1/54* (2013.01); *D01G 15/12* (2013.01); *D04H 1/56* (2013.01); *Y10T 442/698* (2015.04)

(58) Field of Classification Search

None

See application file for complete search history.

(56) References Cited

U.S. PATENT DOCUMENTS

| | | | | |
|---|---|---|---|---|
| 4,118,531 A * | 10/1978 | Hauser | B01D 39/1623 156/62.2 |
| 4,921,645 A * | 5/1990 | Insley | D04H 1/56 264/115 |
| 2004/0126580 A1* | 7/2004 | Gaignard | D04H 1/02 428/373 |
| 2014/0272360 A1* | 9/2014 | Yang | D04H 1/728 428/219 |

FOREIGN PATENT DOCUMENTS

EP 0599396 * 9/1996

* cited by examiner

*Primary Examiner* — Mary Lynn F Theisen

(74) *Attorney, Agent, or Firm* — Platinum Intellectual Property LLP

(57) ABSTRACT

A nonwoven fabric includes a plurality of discontinuous fibers, a plurality of natural keratin fibers, and a plurality of meltblown fibers. The discontinuous fibers, the natural keratin fibers, and the meltblown fibers form a continuous bonding web structure.

11 Claims, 2 Drawing Sheets

NON-WOVEN FABRIC AND METHOD AND APPARATUS OF MANUFACTURING THE SAME

RELATED APPLICATIONS

This application claims priority to Taiwan Application Serial Number 101118712, filed May 25, 2012, which is herein incorporated by reference.

BACKGROUND

Technical Field

The present disclosure relates to fabrics. More particularly, the present disclosure relates to nonwoven fabrics.

Description of Related Art

The down of birds is a layer of fine feathers found under the tougher exterior feathers. Down is one of the best natural thermal insulators. Down is made of fine rachis, on which are barbs and babules interconnected to form a fiborous loose structure. The loose structure encapsulates numerous tiny air pockets that entrap air, which helps to stop convection of air and thus insulate against cold air. Generally, the down is used in warm gears such as jackets, bedding, pillows and sleeping bags by forming a padding like layer.

However, down jackets often give an impression of styleless, bloated and bulky. In addition, in manufacturing a down jacket, a down chamber is formed first, then a preweighted down is blown into the down chamber, and finally the down chamber is seam sealed by needle stitching to restrain the down in the down chamber. Thus, the down jacket may lose its down through the needle holes of the seams. Since along the seams there are only two layers of fabrics stitched together, the space near the seams may only have the lining and the shell without the down, and the down fibers are not bonded together and thus shift around in the down chamber, thereby producing a nonuniform insulation effect. Moreover, in manufacturing the down jacket, sewing and down filling processes require a lot of labor and consuming a lot of time and thus adding up the cost of the jacket. These are the problems that the garment industry must face and the consumers have to pay for when enjoying down.

SUMMARY

According to one embodiment of the present invention, a nonwoven fabric includes a plurality of discontinuous fibers, a plurality of natural keratin fibers, and a plurality of meltblown fibers. The discontinuous fibers, the natural keratin fibers, and the meltblown fibers form a continuous bonding web structure.

Optionally, the meltblown fibers may bond the discontinuous fibers and the natural keratin fibers.

Optionally, each of the meltblown fibers may have a diameter ranging from about 0.5 μm to about 100 μm.

Optionally, the nonwoven fabric may have from about 2.5 wt % to about 95 wt % of the discontinuous fibers, from about 2.5 wt % to about 95 wt % of the natural keratin fibers, and from about 2.5 wt % to about 95 wt % of the meltblown fibers.

Optionally, the meltblown fibers may be made of any thermoplastic resin which is capable of being meltblown.

Optionally, the meltblown fibers may be made of polypropylene (PP), polyethylene (PE), thermoplastic polyurethane (TPU), styrene-butadiene-styrene (SBS), thermoplastic elastomers (TPE), thermoplastic rubber (TPR), polyethylene terephthalate (PET), poly trimethylene terephthalate (PTT), polybutylene terephthalate (PBT), polylactate (PLA), cellulose, polystyrene (PS), polyamide (PA), polytetrafluoroethylene (PTFE), thermomelt plastic, ethylene-methyl acrylate copolymer (EMA), ethylene vinyl acetate copolymer (EVA), or any combination thereof.

Optionally, the discontinuous fibers may be made of polypropylene (PP), polyethylene (PE), polyethylene terephthalate (PET), polybutylene terephthalate (PBT), nylon, acrylic, elastic fibers, rubber, elastane, or any combination thereof.

According to another embodiment of the present invention, an apparatus for manufacturing a nonwoven fabric includes a carding machine, an air source, a feeding channel, a meltblowing machine, and an import channel. The carding machine is for processing a plurality of discontinuous fibers. The air source is for providing airflow. The feeding channel is for directing the airflow to the carding machine to card the discontinuous fibers and to blow a plurality of natural keratin fibers into the spaces between the discontinuous fibers. The meltblowing machine is for providing a curtain of semi-molten meltblown fibers. The import channel is for directing the airflow with the discontinuous fibers and the natural keratin fibers to the curtain of semi-molten meltblown fibers, such that the semi-molten meltblown fibers bond the discontinuous fibers and the natural keratin fibers to form a continuous bonding web structure.

Optionally, the apparatus may include a collecting device. The collecting device is for collecting the continuous bonding web structure to form a fabric roll.

According to yet another embodiment of the present invention, a method for manufacturing a nonwoven fabric includes the following steps: (The steps are not recited in the sequence in which the steps are performed. That is, unless the sequence of the steps is expressly indicated, the sequence of the steps is interchangeable, and all or part of the steps may be simultaneously, partially simultaneously, or sequentially performed.)

(1) processing a plurality of discontinuous fibers by a carding machine;

(2) directing airflow to blow a plurality of natural keratin fibers into the spaces between the discontinuous fibers; and (3) directing the airflow with the discontinuous fibers and the natural keratin fibers to a curtain of semi-molten meltblown fibers, such that the semi-molten meltblown fibers bond the discontinuous fibers and the natural keratin fibers to form a continuous bonding web structure.

Optionally, the method may further include collecting the continuous bonding web structure to form a fabric roll.

Optionally, the method may further include carding the discontinuous fibers and the natural keratin fibers by an air carding machine before directing the airflow with the discontinuous fibers and the natural keratin fibers to the curtain of semi-molten meltblown fibers.

Optionally, the step of directing the airflow with the discontinuous fibers and the natural keratin fibers to the curtain of semi-molten meltblown fibers may include directing the airflow with the carded discontinuous fibers and the carded natural keratin fibers to the curtain of semi-molten meltblown fibers.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
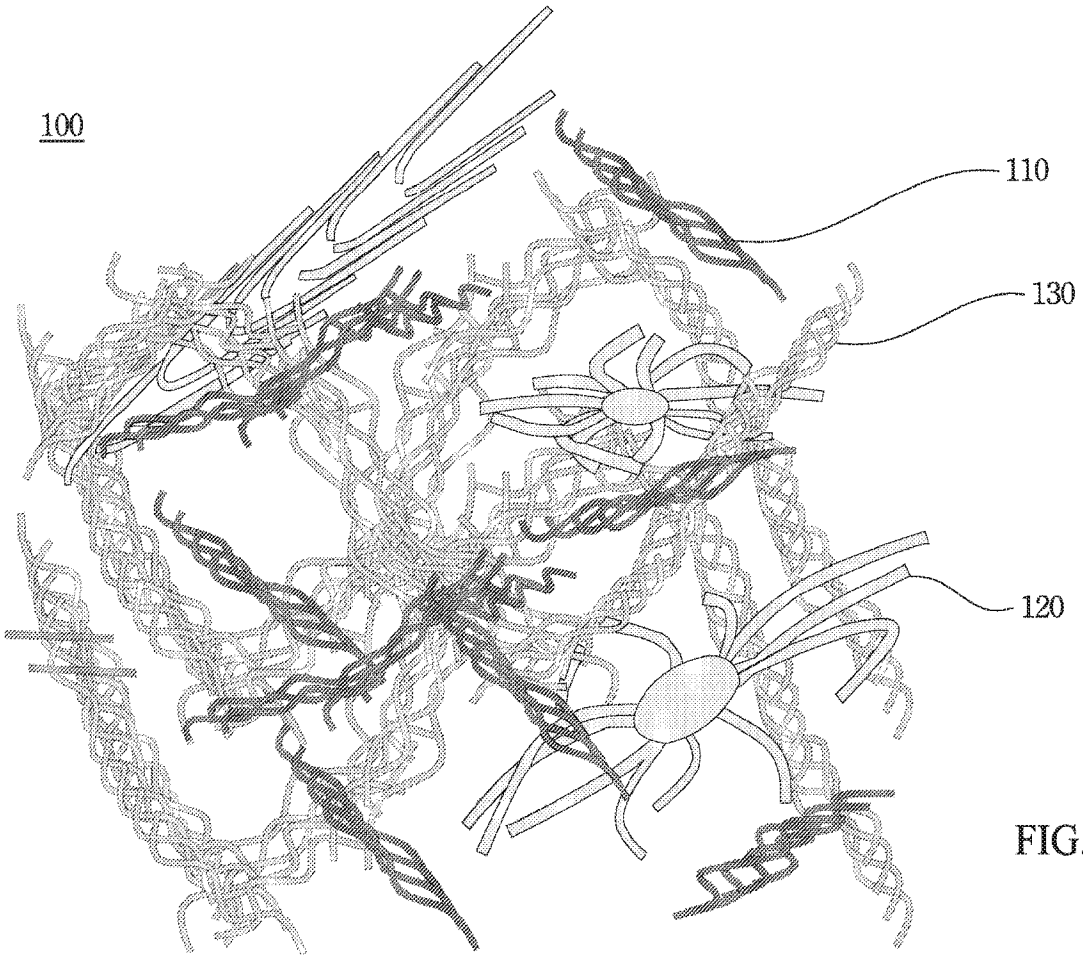
FIG. 1 is a drawing of a nonwoven fabric according to one embodiment of the present invention.

FIG. 1 is a drawing of a nonwoven fabric 100 according to one embodiment of the present invention. As shown in FIG. 1, the nonwoven fabric 100 includes a plurality of discontinuous fibers 110, a plurality of natural keratin fibers 120, and a plurality of meltblown fibers 130. The discontinuous fibers 110, the natural keratin fibers 120, and the meltblown fibers 130 form a continuous bonding web structure.

In FIG. 1, the discontinuous fibers 110 can be the framework of the nonwoven fabric 100 to provide the nonwoven fabric 100 with suitable fluffiness, softness-stiffness, and resilience. The natural keratin fibers 120 have small air pockets to provide the nonwoven fabric 100 with insulation and warmth. Furthermore, the natural keratin fibers 120 can increase the compressional resilience of the nonwoven fabric 100 as well. The meltblown fibers 130 can bond the discontinuous fibers 110 and the natural keratin fibers 120 to form a continuous bonding web structure. Furthermore, since the meltblown fibers 130 and spaces between the meltblown fibers 130 are small enough, the meltblown fibers can enhance the insulation and warmth of the nonwoven fabric 100 as well.

Relative to long fibers or continuous fibers, the discontinuous fibers 110, also known as short fibers, have a general aspect ratio (defined as the ratio of fiber length to diameter) ranging from about 20 to about 60. The length of the discontinuous fibers 110 may range from about 17 mm to about 61 mm. The discontinuous fibers 110 may be made of polypropylene (PP), polyethylene (PE), polyethylene terephthalate (PET), recycled PET, insulation PET, polybutylene terephthalate (PBT), nylon, acrylic, elastic fibers, rubber, elastane, or any combination thereof which has fiber formability, suitable softness-stiffness, and resilience.

The natural keratin fibers 120 are made of natural keratin. Specifically, the natural keratin fibers 120 can be, for example, down and/or feathers of birds, animal fur, or any combination thereof.

The meltblown fibers 130 are fibers manufactured by melt blowing. The diameter of the meltblown fibers 130 may range from about 0.5 μm to about 100 μm. In the present embodiment, the meltblown fibers 130 can bond the discontinuous fibers 110 and the natural keratin fibers 120 to form a continuous bonding web structure.

The meltblown fibers 130 are made of any thermoplastic resin which is capable of being meltblown, for example polypropylene (PP), polyethylene (PE), thermoplastic polyurethane (TPU), styrene-butadiene-styrene (SBS), thermoplastic elastomers (TPE), thermoplastic rubber (TPR), polyethylene terephthalate (PET), poly trimethylene terephthalate (PTT), polybutylene terephthalate (PBT), polylactate (PLA), cellulose, polystyrene (PS), polyamide (PA), polytetrafluoroethylene (PTFE), thermomelt plastic, ethylene-methyl acrylate copolymer (EMA), ethylene vinyl acetate copolymer (EVA), or any combination thereof.

The weight ratio of the discontinuous fibers 110, the natural keratin fibers 120, and the meltblown fibers 130 in the nonwoven fabric 100 of FIG. 1 depends on actual requirements. In the present embodiment, the nonwoven fabric 100 has from about 2.5 wt % to about 95 wt % of the discontinuous fibers 110, from about 2.5 wt % to about 95 wt % of the natural keratin fibers 120, and from about 2.5 wt % to about 95 wt % of the meltblown fibers 130.

The nonwoven fabric 100 of FIG. 1 has a base weight ranging from about 50 $g/m^2$ to about 500 $g/m^2$ and a thickness ranging from about 0.3 mm to about 50 mm. It should be appreciated that the aforementioned specifications of the nonwoven fabric 100 are illustrative only and should not limit the claimed scope of the present disclosure. Any one of ordinary skill in the art should be able to determine the specifications of the nonwoven fabric according to actual requirements.

Figure 2:
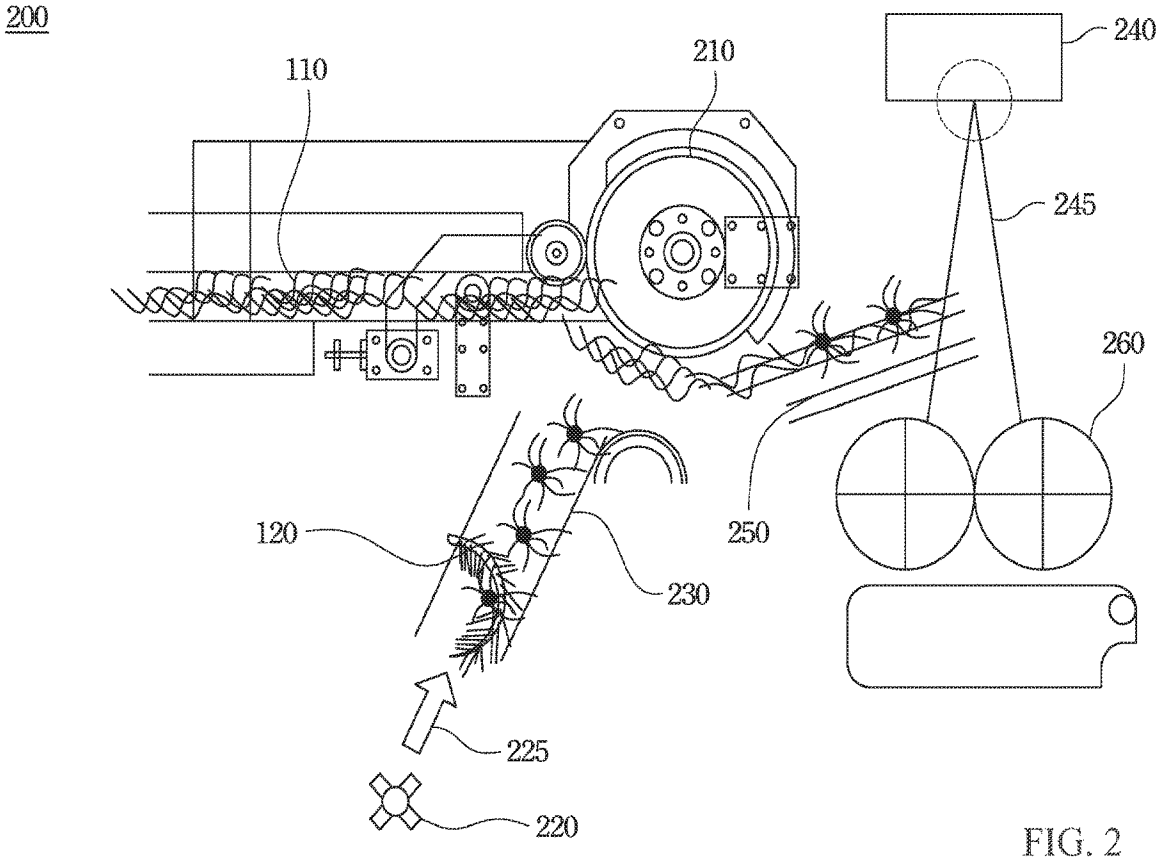
FIG. 2 is a drawing of an apparatus for manufacturing a nonwoven fabric according to one embodiment of the present invention.

FIG. 2 is a drawing of an apparatus 200 for manufacturing a nonwoven fabric 100 according to one embodiment of the present invention. As shown in FIG. 2, the apparatus 200 for manufacturing the nonwoven fabric 100 includes a carding machine 210, an air source 220, a feeding channel 230, a meltblowing machine 240, and an import channel 250. The carding machine 210 is for processing a plurality of discontinuous fibers 110. The air source 220 is for providing airflow 225. The feeding channel 230 is for directing the airflow 225 to the carding machine 210 to card the discontinuous fibers 110 and to blow a plurality of natural keratin fibers 120 into the spaces between the discontinuous fibers 110. The meltblowing machine 240 is for providing a curtain of semi-molten meltblown fibers 245. The import channel 250 is for directing the airflow 225 with the discontinuous fibers 110 and the natural keratin fibers 120 to the curtain of semi-molten meltblown fibers 245, such that the semi-molten meltblown fibers 130 bond the discontinuous fibers 110 and the natural keratin fibers 120 to form a continuous bonding web structure.

The carding machine 210 is a machine that can disentangle, clean and intermix the discontinuous fibers 110. In the present embodiment, the carding machine 210 includes a cylinder carding cloth. In use, the cylinder carding cloth which rotates at high speeds can catch the discontinuous fibers 110 and move the discontinuous fibers 110 to a place adjacent to the feeding channel 230 where the discontinuous fibers 110 and the natural keratin fibers 120 are mixed. The specifications of the cylinder carding cloth depend on the required mixing uniformity. In the present embodiment, the density of the cylinder carding cloth may range from about 3 p/in to about 120 p/in. The angle of the cylinder carding cloth may vary from about 27° to about 80°. The angle of the cylinder carding cloth may affect the properties of the discontinuous fibers 110 which may be broken up by the cylinder carding cloth.

The air source 220 may be a blower. The flowing rate of the airflow 225 may vary from about 1 m/s to about 60 m/s.

As shown in FIG. 2, the feeding channel 230 is connected to a place below the cylinder carding cloth, i.e. the carding machine 210, such that the natural keratin fibers 120 are not caught and broken up by the cylinder carding cloth, i.e. the carding machine 210. In the case that some of the natural keratin fibers 120 need to be broken up in manufacturing the nonwoven fabric 100, the feeding channel 230 may be connected to a place above the cylinder carding cloth, i.e. the carding machine 210. By such an arrangement, the cylinder carding cloth, i.e. the carding machine 210, can catch the natural keratin fibers 120, and some of the natural keratin fibers 120 may be broken up by the cylinder carding cloth, i.e. the carding machine 210. Any one of ordinary skill in the art should be able to determine the detail structure of the feeding channel 230 according to actual requirements.

The feeding rate of the discontinuous fibers 110 depend on the required weight ratio. In the present embodiment, the feeding rate of the discontinuous fibers 110 may range from about 1 m/min to about 3 m/min. The number and distribution of the natural keratin fibers 120 depend on the gaps of the cylinder carding cloth, i.e. the carding machine 210, and the rate of the airflow 225.

Whether the discontinuous fibers 110 and the natural keratin fibers 120 are broken up by the cylinder carding cloth, i.e. the carding machine 210, almost all of the discontinuous fibers 110 and the natural keratin fibers 120 can be blown into the curtain of semi-molten meltblown fibers 245. Even if a very small part of the discontinuous fibers 110 and the natural keratin fibers 120 is caught on the cylinder carding cloth, i.e. the carding machine 210, this part of the discontinuous fibers 110 and the natural keratin fibers 120 will be used in the next turn of the cylinder, and thus the number of void if any will be minimized to undetectable.

The semi-molten meltblown fibers 130 bond the discontinuous fibers 110 and the natural keratin fibers 120 at a place ranging from about 1 cm to about 50 cm below the die of the meltblowing machine 240 after the discontinuous fibers 110 and the natural keratin fibers 120 are blown into the curtain of semi-molten meltblown fibers 245. Since the meltblown fibers 130 are semi-molten at this time, the semi-molten meltblown fibers 130 can stick to the discontinuous fibers 110 and the natural keratin fibers 120 and also encompass them together before solidifying. In this way, the discontinuous fibers 110, the natural keratin fibers 120, and the meltblown fibers 130 are firmly bonded together to form a continuous bonding web structure with good abrasion and pilling resistance. The process air pressure of the meltblowing machine 240 may range from about 5 psi to about 15 psi.

As shown in FIG. 2, the apparatus 200 for manufacturing the nonwoven fabric 100 may further include a collecting device 260. The collecting device 260 is for collecting the continuous bonding web structure formed by the discontinuous fibers 110, the natural keratin fibers 120, and the meltblown fibers 130 to form a fabric roll. In the present embodiment, the collecting device 260 may be a conveyor belt, a roller, a vacuum pump, or any combination thereof. Furthermore, the vertical distance between the die of the meltblowing machine 240 and the collecting device 260 may range from about 10 cm to about 50 cm.

Another aspect of the present invention is a method for manufacturing a nonwoven fabric 100. The method for manufacturing the nonwoven fabric 100 includes the following steps: (The steps are not recited in the sequence in which the steps are performed. That is, unless the sequence of the steps is expressly indicated, the sequence of the steps is interchangeable, and all or part of the steps may be simultaneously, partially simultaneously, or sequentially performed.)

(1) processing a plurality of discontinuous fibers 110 by a carding machine 210;

(2) directing airflow 225 to blow a plurality of natural keratin fibers 120 into the spaces between the discontinuous fibers 110; and (3) directing the airflow 225 with the discontinuous fibers 110 and the natural keratin fibers 120 to a curtain of semi-molten meltblown fibers 245, such that the semi-molten meltblown fibers 130 bond the discontinuous fibers 110 and the natural keratin fibers 120 to form a continuous bonding web structure.

In one or more embodiments of the present invention, the method for manufacturing the nonwoven fabric 100 may further include the following steps:

(4) collecting the continuous bonding web structure formed by the discontinuous fibers 110, the natural keratin fibers 120, and the meltblown fibers 130 to form a continuous fabric roll with some physical strength.

In one or more embodiments of the present invention, the method for manufacturing the nonwoven fabric 100 may further include the following steps:

(2.5) carding the discontinuous fibers 110 and the natural keratin fibers 120 by an air carding machine before directing the airflow 225 with the discontinuous fibers 110 and the natural keratin fibers 120 to the curtain of semi-molten meltblown fibers 245.

That is, the discontinuous fibers 110 and the natural keratin fibers 120 are carded by the air carding machine before blown into the curtain of semi-molten meltblown fibers 245. In this way, the discontinuous fibers 110 and the natural keratin fibers 120 can be mixed more uniformly, and therefore the quality of the nonwoven fabric 100 is improved.

The air carding machine is a sub-element of the carding machine 210 which can card and mix the discontinuous fibers 110 and the natural keratin fibers 120 uniformly.

In one or more embodiments of the present invention, the step (3) may includes:

(3.1) directing the airflow 225 with the carded discontinuous fibers 110 and the carded natural keratin fibers 120 to the curtain of semi-molten meltblown fibers 245, such that the semi-molten meltblown fibers 130 bond the discontinuous fibers 110 and the natural keratin fibers 120 to form a continuous bonding web structure.

Working Example

A series of tests were run to determine that the aforementioned apparatus and method could manufacture the required nonwoven fabrics. The parameters described before are not repeated hereinafter, and only further information is supplied to actually perform the series of tests.

In the following working examples 1-3, the nonwoven fabrics were manufactured by the apparatus of FIG. 2. The specifications and manufacturing parameters are listed in the following table 1. In the following working examples 1-3, the discontinuous fibers were made of polyethylene terephthalate (PET), the natural keratin fibers were 650 fill power down, and the meltblown fibers were made of polypropylene (PP).

TABLE 1

Specifications and Manufacturing Parameters of Working Example 1-3

| | Working Example 1 | Working Example 2 | Working Example 3 |
|---|---|---|---|
| Feeding Rate of Natural Keratin Fibers (Hz) | 12.3 | 11.6 | 6.8 |
| Distribution Airflow of Natural Keratin Fibers (Hz) | 60 | 50 | 40 |
| Feeding Rate of Discontinuous Fibers (Hz) | 20.6 | 18.3 | 10.1~12.5 |
| Rotational Speed of Carding Machine (Hz) | 60 | 50 | 40 |
| Flowing Rate of Airflow (m/s) | 3.3~5.3 | 2.6~2.9 | 1.9~2.1 |

TABLE 1-continued

Specifications and Manufacturing Parameters of Working Example 1-3

| | Working Example 1 | Working Example 2 | Working Example 3 |
|---|---|---|---|
| Feeding Distance (cm)[1] | 18 | 10 | 5 |
| Feeding Height (cm)[2] | 25 | 18 | 10 |

Note
[1]The feeding distance is the horizontal distance between the outlet of the feeding channel and the middle axis of the curtain of semi-molten meltblown fibers.
Note
[2]The feeding height is the vertical distance between the bottom edge of the outlet of the feeding channel and the die of the meltblowing machine.

In the nonwoven fabrics manufactured according to the specifications and manufacturing parameters listed in the table 1, the weight ratios of the meltblown fibers, the discontinuous fibers, and the natural keratin fibers are listed in the following table 2.

TABLE 2

Contents of Nonwoven Fabrics of Working Example 1-3

| | Working Example 1 | Working Example 1 | Working Example 1 |
|---|---|---|---|
| Weight Ratio[3] | 1.0:1.3:2.7 | 1.0:1.1:2.2 | 1.0:1.1:1.2 |

Note
[3]The weight ratio is the weight of the meltblown fibers:the weight of the discontinuous fibers:the weight of the natural keratin fibers.

The nonwoven fabrics of the working examples 4-5 and the comparative examples 1-3 were compared in the following table 3. The nonwoven fabrics of the working examples 4-5 were manufactured by the apparatus of FIG. 2. The nonwoven fabric of the comparative example 1 contained the meltblown fibers only. The nonwoven fabric of the comparative example 2 contained the meltblown fibers and the discontinuous fibers only. The nonwoven fabric of the comparative example 3 contained the meltblown fibers and the natural keratin fibers only. In the nonwoven fabrics of the working examples 4-5 and the comparative examples 1-3, the discontinuous fibers 110 were made of polyethylene terephthalate (PET), the natural keratin fibers 120 were 650 fill power down, and the meltblown fibers 130 were made of polypropylene (PP). Other specifications and manufacturing parameters of the working examples 4-5 and the comparative examples 1-3 were the same.

TABLE 3

Comparison of Working Examples 4-5 and Comparative Examples 1-3

| | Base Weight ($g/m^2$) | | Thickness (cm) | | Fluffy Rate | Softness-Stiffness |
|---|---|---|---|---|---|---|
| | Average | Uniformity | Average | Uniformity | ($cm^3/g$) | (cm) |
| Comparative Example 1 | 51.6 | 90% | 0.38 | 78% | 7.3 | 2.5 |
| Comparative Example 2 | 189.5 | 89% | 1.58 | 95% | 8.3 | 2.6 |
| Comparative Example 3 | 63.8 | 93% | 1.52 | 91% | 23.8 | 2.5 |
| Working Example 4 | 101.6 | 94% | 2.96 | 97% | 29.1 | 2.8 |
| Working Example 5 | 85.8 | 92% | 1.55 | 94% | 18.0 | 2.7 |

As listed in the table 3, the uniformities of the base weights of the nonwoven fabrics of the working examples 4-5 were larger than 90%, specifically from 92% to 94%. Since the nonwoven fabrics of the working examples 4-5 had the discontinuous fibers, the fluffy rates of the nonwoven fabrics of the working examples 4-5 were from 12 $cm^3/g$ to 30 $cm^3/g$, specifically from 18.0 $cm^3/g$ to 29.1 $cm^3/g$, and the softnesses-stiffnesses of the nonwoven fabrics of the working examples 4-5 were less than 3 cm, specifically from 2.7 cm to 2.8 cm. These data were better than that of the comparative examples 1-3.

The nonwoven fabrics of the working example 6 and the comparative examples 4-6 were compared in the following tables 4-5. The nonwoven fabrics of the working example 6 were manufactured by the apparatus of FIG. 2. The nonwoven fabric of the comparative example 4 contained the meltblown fibers only. The nonwoven fabric of the comparative example 5 contained the meltblown fibers and the discontinuous fibers only. The nonwoven fabric of the comparative example 6 were 3M™ Thinsulate™. In the nonwoven fabrics of the working example 6 and the comparative examples 4-6, the discontinuous fibers were made of polyethylene terephthalate (PET), the natural keratin fibers were 650 fill power down, and the meltblown fibers were made of polypropylene (PP). Other specifications and manufacturing parameters of the working example 6 and the comparative examples 4-6 were the same.

TABLE 4

Comparison of Working Example 6 and Comparative Examples 4-6

| | Insulation per Unit Thickness (CLO/cm) | Heat Preservation Rate (%) | Heat Transfer Coefficient ($W/m^2 \cdot °C.$) | Thermal Resistance ($m^2 \cdot °C./W$) | Thermal Resistance ($°F. \cdot h \cdot ft^2/Btu$) |
|---|---|---|---|---|---|
| Comparative Example 4 | 0.94-1.3 | 65.3 | 0.0350 | 0.2026 | 1.1508 |
| Comparative Example 5 | 1.72 | 78.2 | 0.0317 | 0.1291 | 0.7333 |
| Comparative Example 6 | 1.7 | 60 | 0.0341 | 0.3471 | 1.9710 |
| Working Example 6 | 2.0-2.4 | 80.7 | 0.0310 | 0.0966 | 0.5485 |

TABLE 5

Comparison of Working Example 6 and Comparative Examples 4-6

| | Compressional Resilience (%) | Diameter (μm) |
|---|---|---|
| Comparative Example 4 | 75% | 0.9-3.3 (meltblown fibers) |
| Comparative Example 5 | 88% | 0.9-3.3 (meltblown fibers)<br>15.3 (discontinuous fibers) |
| Comparative Example 6 | 89% | 1.7~6.0 (meltblown fibers)<br>25.6 (discontinuous fibers) |
| Working Example 6 | 92% | 0.9-3.3 (meltblown fibers)<br>15.3 (discontinuous fibers) |

As listed in the tables 4-5, since the nonwoven fabric of the working example 6 had down, in comparison with the comparative example 6, the insulation per unit thickness increases by from 17% to 41%, the heat preservation rate increases by 34%, and the compressional resilience increases by 3%.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. § 112, 6th paragraph. In particular, the use of "step of" in the claims is not intended to invoke the provisions of 35 U.S.C. § 112, 6th paragraph.

What is claimed is:

1. A method for manufacturing a nonwoven fabric, the method comprising:

processing a plurality of discontinuous fibers by a carding machine;

directing airflow to blow a plurality of natural keratin fibers into spaces between the discontinuous fibers; and directing the airflow with the discontinuous fibers and the natural keratin fibers to a curtain of semi-molten meltblown fibers, such that the semi-molten meltblown fibers bond the discontinuous fibers and the natural keratin fibers to form a continuous bonding web structure.

2. The method of claim 1, further comprising:

collecting the continuous bonding web structure to form a fabric roll.

3. The method of claim 1, further comprising:

carding the discontinuous fibers and the natural keratin fibers by an air carding machine before directing the airflow with the discontinuous fibers and the natural keratin fibers to the curtain of semi-molten meltblown fibers; and wherein directing the airflow with the discontinuous fibers and the natural keratin fibers to the curtain of semi-molten meltblown fibers comprises:

directing the airflow with the carded discontinuous fibers and the carded natural keratin fibers to the curtain of semi-molten meltblown fibers.

4. The method of claim 1, comprising carding discontinuous fibers and natural keratin fibers before directing the airflow with discontinuous fibers and natural keratin fibers to the curtain of semi-molten meltblown fibers.

5. The method of claim 1, wherein directing the airflow with the discontinuous fibers and the natural keratin fibers to the curtain of semi-molten meltblown fibers comprises:

directing the airflow with the carded discontinuous fibers and the carded natural keratin fibers to the curtain of semi-molten meltblown fibers.

6. The method of claim 1, comprising fabricating a nonwoven fabric with a framework made of a plurality of discontinuous fibers, wherein a diameter of the discontinuous fibers is in a range from 283 μm to 3050 μm, and a length of the discontinuous fibers is in a range from 17 mm to 61 mm, wherein a plurality of natural keratin fibers fed into spaces between the discontinuous fibers formed using an import channel for directing airflow with the discontinuous fibers and the natural keratin fibers to a curtain of semi-molten meltblown fibers; and a plurality of meltblown fibers, wherein the meltblown fibers have a diameter in a range from 0.5 μm to 100 μm, and the meltblown fibers bond the fiber mixture as a continuous bonding web structure, where the semi-molten meltblown fibers bond the discontinuous fibers and the natural keratin fibers.

7. The method of claim 1, wherein the nonwoven fabric has from about 2.5 wt % to about 95 wt % of the discontinuous fibers, from about 2.5 wt % to about 95 wt % of the natural keratin fibers, and from about 2.5 wt % to about 95 wt % of the meltblown fibers.

8. The method of claim 1, wherein the meltblown fibers are made of any thermoplastic resin which is capable of being meltblown.

9. The method of claim 1, wherein the meltblown fibers are made of polypropylene (PP), polyethylene (PE), thermoplastic polyurethane (TPU), styrene-butadiene-styrene (SBS), thermoplastic elastomers (TPE), thermoplastic rubber (TPR), polyethylene terephthalate (PET), poly trimethylene terephthalate (PTT), polybutylene terephthalate (PBT), polylactate (PLA), cellulose, polystyrene (PS), polyamide (PA), polytetrafluoroethylene (PTFE), thermomelt plastic, ethylene-methyl acrylate copolymer (EMA), ethylene vinyl acetate copolymer (EVA), or any combination thereof.

10. The method of claim 1, wherein the discontinuous fibers are made of polypropylene (PP), polyethylene (PE), polyethylene terephthalate (PET), polybutylene terephthalate (PBT), nylon, acrylic, elastic fibers, rubber, elastane, or any combination thereof.

11. An apparatus for manufacturing a nonwoven fabric, the apparatus comprising:

a carding machine for processing a plurality of discontinuous fibers; an air source for providing airflow;

a feeding channel for directing the airflow to the carding machine to card the discontinuous fibers and to blow a plurality of natural keratin fibers into spaces between the discontinuous fibers;

a meltblowing machine for providing a curtain of semi-molten meltblown fibers; and an import channel for directing the airflow with the discontinuous fibers and the natural keratin fibers to the curtain of semi-molten meltblown fibers, such that the semi-molten meltblown fibers bond the discontinuous fibers and the natural keratin fibers to form a continuous bonding web structure.

* * * * *